US005447487A

United States Patent [19]

Alberto

[11] Patent Number: 5,447,487

[45] Date of Patent: Sep. 5, 1995

[54] DEVICE FOR DETACHING AND REATTACHING APORTION OF A CASE BLANK IN A STEPWISE OPERATED PACKAGING LINES

[75] Inventor: Miselli C. Alberto, Castel S. Pietro, Italy

[73] Assignee: I.M.A. Industria Macchine Automatiche S.p.A., Oaaano Emilia, Bologna, Italy

[21] Appl. No.: 373,581

[22] Filed: Jan. 17, 1995

[30] Foreign Application Priority Data

Jan. 20, 1994 [IT] Italy ..... BO94U0006

[51] Int. Cl.[6] ..... B31B 1/60

[52] U.S. Cl. ..... 493/114; 493/379; 493/344; 156/264; 156/512

[58] Field of Search ..... 156/264, 512; 493/379, 493/84, 114, 343, 344

[56] References Cited

U.S. PATENT DOCUMENTS

| | | | |
|---|---|---|---|
| 2,808,871 | 10/1957 | Brown | 493/379 |
| 3,964,953 | 6/1976 | Mitchard et al. | 493/379 |
| 4,664,648 | 5/1987 | Dupuy | 493/84 |
| 5,069,658 | 12/1991 | Dupuy | 493/379 |
| 5,240,173 | 8/1993 | Dagostine | 493/84 |

*Primary Examiner*—John Sipos
*Assistant Examiner*—Gene L. Kim
*Attorney, Agent, or Firm*—McAulay Fisher Nissen Goldberg & Kiel

[57] ABSTRACT

A device for detaching a portion from the main part of a blank and for reattaching the portion to another zone of the main part, includes gripping and pushing means for gripping and moving the portion of the blank, while supporting means support the main part of the blank with the portion free to move downwards. Operating means drive the gripping and pushing means while gluing means apply glue on the surface of the portion to be attached to the main part of the blank.

8 Claims, 5 Drawing Sheets

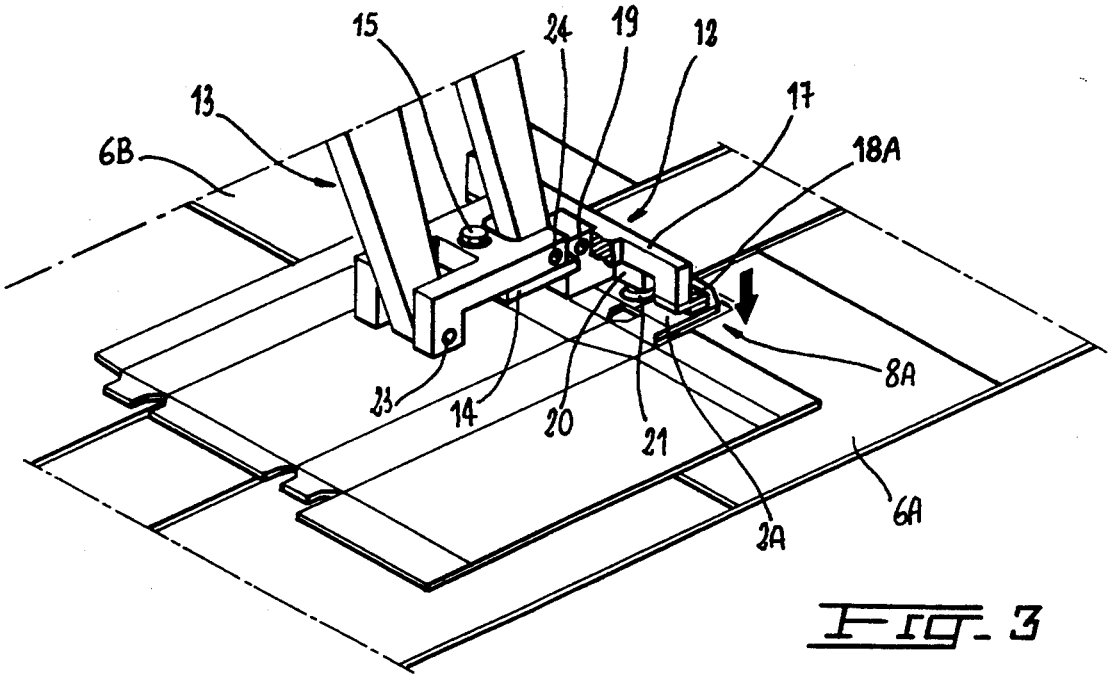
Fig. 3
Fig. 3A
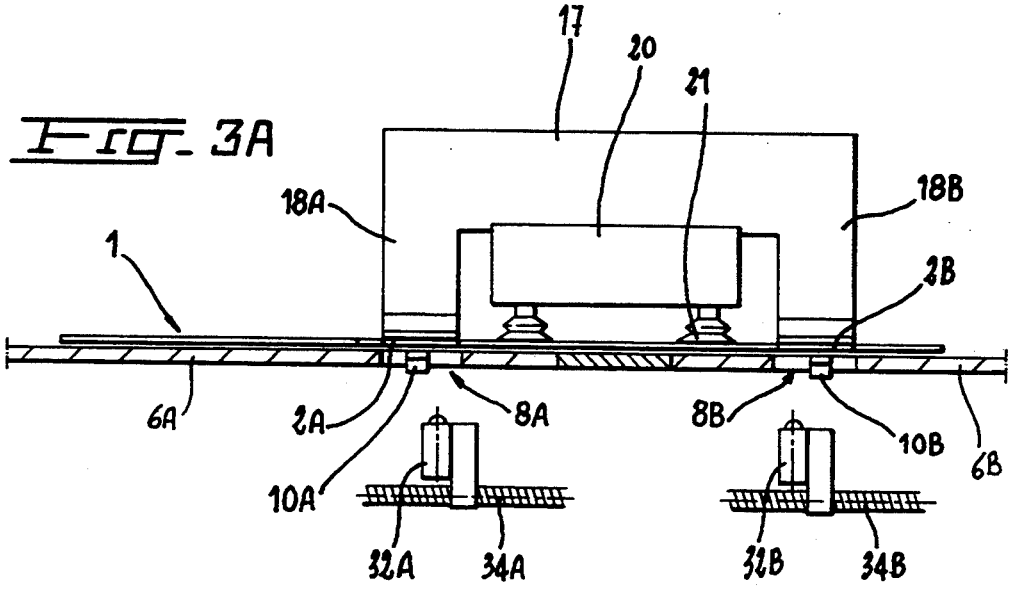
Fig. 3B
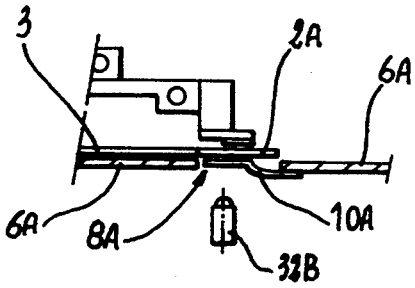

Fig. 4A
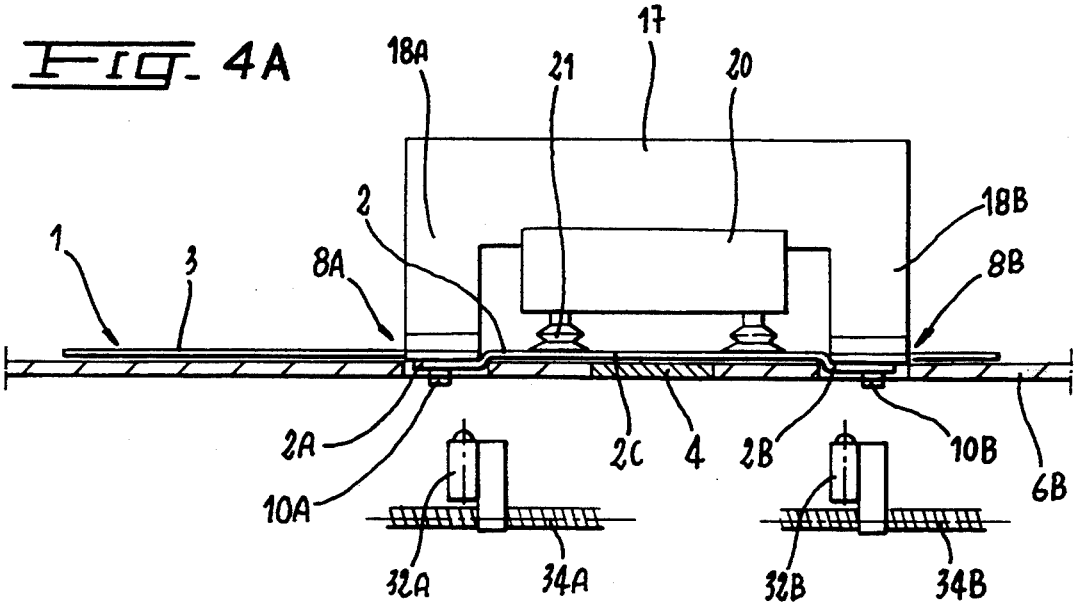
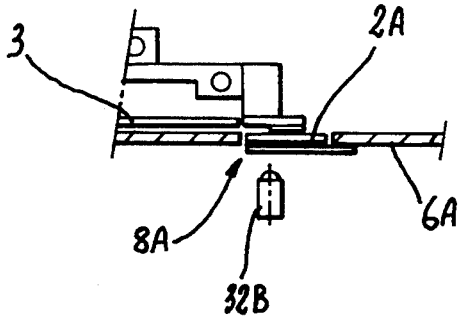
Fig. 4B

DEVICE FOR DETACHING AND REATTACHING APORTION OF A CASE BLANK IN A STEPWISE OPERATED PACKAGING LINES

BACKGROUND OF THE INVENTION

The present invention relates to a device that is mounted on a stepwise operated packaging line, and that when a case is set up starting from a blank, it detaches a portion from the blank and then reattaches the detached portion to a different zone of the same blank.

DESCRIPTION OF THE PRIOR ART

Generally, machines used for erecting and filling cases obtained from flat blanks, feature a stepwise operated line for setting up the cases from flat blanks.

This case set up line basically includes a conveyor, operated in step, on which a series of blanks positioned at regular intervals are conveyed.

Each single blank is sequentially stopped in a plurality of consecutive dwell stations equipped with respective operative units.

Each subsequent operative station is designed to perform a specific operation. Accordingly, the cases forming line includes e.g. a first station for receiving and gripping the blanks fed one by one, a second station for checking the blank, a third station for checking the presence of the same blank in view of the subsequent operations, a fourth station for detaching a portion of the blank designed to form e.g. a collar for the case being erected, and for reattaching the detached portion in another zone of the blank, a fifth station for partial folding the blank, a sixth station for forming a tubular body defining a case, etc.

SUMMARY OF THE INVENTION

The object of the present invention is to propose a separating-applying device working an operative station, in which a blank, that includes many parts, dwells and in which a portion of the blank is detached from a main part in a safe and precise way, then the said detached part is shifted with respect to the blank and reattached to another zone of the main part.

Another object of the present invention is to propose a separating-applying device as described above, that can be easily adapted to different shapes of blanks without any phase adjustment of the cases forming line and without using specialised personnel.

The present invention, as described in the appended claims, concerns a detaching-reattaching device designed to work as a handling unit in an operative station of the above mentioned cases erecting line.

The detaching-reattaching device according to the present invention provides for a secure and effective detaching of the portion of blank, a translation of the portion of blank firmly held, and a precise attachment of the portion to the same blank.

The device according to the invention includes gripping-pushing means designed to grip, push downwards and move the detachable portion of the blank that is resting on supporting means which allow free downward movements for the portion to be detached.

Operating means drive the gripping-pushing means while gluing means apply glue to the surface of the portion to be attached to the main part of the blank.

DESCRIPTION OF THE DRAWINGS

Other objects, features and advantages of the invention will appear from the following detailed description of the preferred embodiment given, as a mere not limitative example, in conjunction with the accompanying drawings, in which:

FIG. 3 shows a perspective view of a detail of the subject device when the portion to be reattached is gripped;

FIGS. 3A and 3B show, respectively, a side sectional lateral schematic view and a partial rear sectional schematic view of a detail of FIG. 3, and concern the zone of gripping and separation of the blank portion;

FIGS. 4*a* and 4*b*, show respectively the same details of FIGS. 3A and 3B, while the subject device is detaching the blank portion to be reattached;

DESCRIPTION OF THE PREFERRED EMBODIMENT

Figure 1:
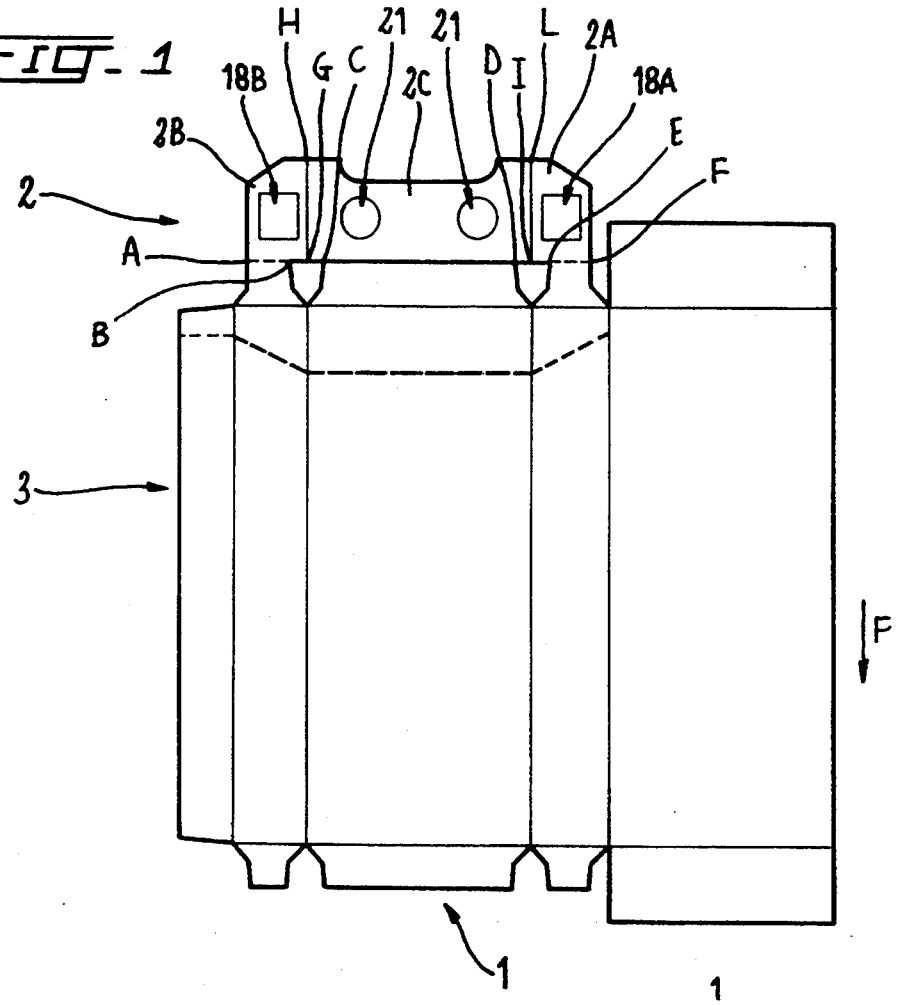
FIG. 1 is a plan view of a blank being handled.

With reference to FIG. 1, reference numeral 1 indicates a case blank 1, with creasing lines, indicated by thin lines, aimed at facilitating subsequent folding of the blank, and with breaking lines, indicated by hatched lines, designed to facilitate detachment of a blank portion from the blank.

Basically, the blank 1 includes two parts, that is a main part 3 and a detachable portion 2. The detachable portion is formed at the rear end of the blank 1, considering the advancement direction F, and is delimited by a segment line A–F.

The detachable portion 2 is joined to the main part 3 by two breaking lines A–B, E–F, while the central part of the segment A–F includes a cut C–D along which the portion 2 is detached from the part 3.

Still referring to FIG. 1, the detachable portion 2 includes a central area 2*c*, delimited by the sections H–G, G–I and I–L, and two lateral areas 2*a*, 2*b*, which are delimited by the sections A–G, G–H and by the sections I–F, I–L, respectively.

Figure 7:
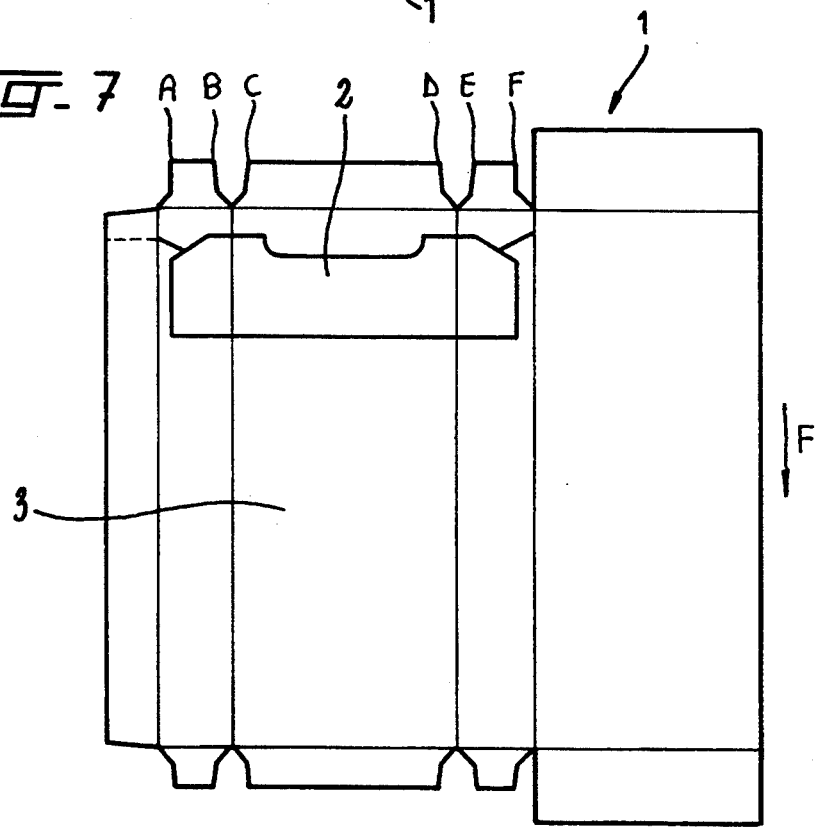
FIG. 7 is a plan view of the blank after completition of the reapplication of the portion.

The device, being the subject of the present invention, detaches the portion 2 from the blank 1, shifts it over the main part 3 and attaches it to a different zone of the main part 3 by gluing or other known way, so that the configuration of FIG. 7 is obtained.

Figure 2:
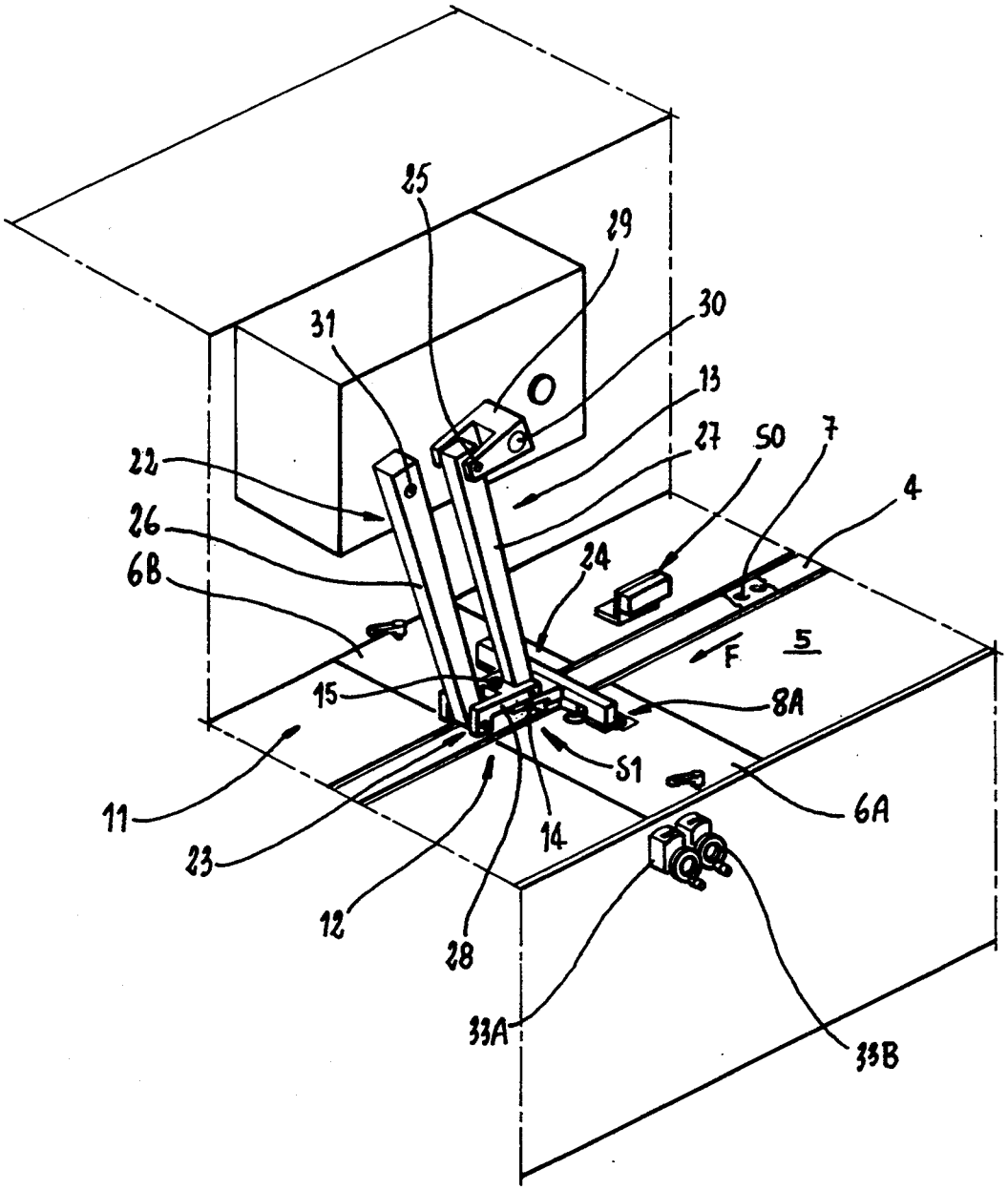
FIG. 2 shows a perspective view of a station including the device being the subject of the present invention without the blank to be handled.

With reference to FIG. 2, the case erecting line is equipped with a conveyor 4, e.g. a closed loop belt conveyor provided with suction gripping means 7 turned upwards.

This conveyor 4 carries stepwise the blanks 1 in the direction indicated by the arrow F, making them dwell in the subsequent operative stations.

FIG. 2 shows only two subsequent operative stations, namely a station SO, where presence of the blank 1 is checked, and a station S1, in which the portion 2 is detached from the blank 1, shifted with respect of the main part 3, and reattached thereto, so as to obtain the configuration shown in FIG. 7.

The case erecting line has also a straight conveying or sliding surface 5. Near the said station S1 there are two removable plates 6*a* and 6*b*, which are part of the sliding surface 5 and which feature two openings 8*a* and 8*b* (see also FIGS. 3, 3*a*, 3*b*, 4*a*, 4*b*).

A pair of elastic members 10*a*,10*b* are secured to the bottom side of the plates 6*a*,6*b* and extend into the openings 8*a*,8*b* for the reason better explained below.

Over the pair of plates 6*a*, 6*b*, there is a movable member 11 comprising gripping and pushing means 12 and operating means 13.

The gripping and pushing means 12 include a carrier member 14, fastened removably, by means of a screw 15, to the operating means 13.

On its end upstream of the case erecting line, the carrier member 14 carries a transversal bar 17, that features, at its ends, a pair of thrusting heads 18*a*, 18*b*, extending downwards for the reasons explained in the following.

Moreover, an oscillating element 20 is pivoted in 19 to the carrier member 14.

On its free end, the oscillating element 20 carries a plurality of suction cups 21 turned downwards for the reasons explained in the following.

The operating means 13 (see FIG. 2), include a linked parallelogram, with four pivot points 22, 23, 24, and 25, two arms 26, 27, and a connecting yoke element 28 that is joined to the element 14 by means of the above mentioned screw 15.

The pivot point 25 of the parallelogram is hinged to a rocking element 29 that is keyed onto a shaft 30, while the pivot point of the arm 26 is keyed onto a shaft 31, for the reasons given in the following.

With particular reference to FIGS. 3, 3*a*, 3*b*, under the plates 6*a*, 6*b* there are placed a pair of glue sprayers 32*a*, 32*b*, designed to spray glue upwards through the two openings 8*a* and 8*b*.

These sprayers 32*a*, 32*b* can be separately adjusted transversely by respective moving handwheels 33*a* and 33*b* acting on respective rods 34*a*, 34*b* (see also FIG. 2).

The blank 1 is carried by the conveyor 4 and held by the gripping means 7 that grip the blank in various points situated only on the surface turned downwards of the main part 3; the gripping means 7 do not act on the surface of the portion 2.

In this way, the blank 1 dwells in the station SO so that its presence can be detected by known devices, not illustrated, since not related to the present invention.

After having verified the presence of the blank 1, in the subsequent step the blank is transferred from the station SO to the station S1 and stopped therein, where the portion 2 is detached, shifted downstream, and reattached to the main part 3.

Thus the configuration shown in FIG. 7 is obtained.

With reference to FIG. 3, when the blank 1 reaches the station S1, the linked parallelogram is situated in its extreme upstream oscillation point, with reference to the advancement direction of the blank.

By counter-clockwise rotation of the shaft 30, the element 29 swings accordingly, and the arm 27 is lowered (see FIGS. 3*a*, 3*b*) so that the suction cups 21 grip the central area 2*c* of the portion 2, while the two thrusting heads 18*a*, 18*b* go to touch the lateral areas of the same portion 2.

FIG. 1 shows as a non limitative example, the contact points of the said suction cups 21 and thrusting heads 18*a*, 18*b* during this step.

Afterwards, the left-handed swing motion of the element 29 continues and, (see FIGS. 4*a*, 4*b*) the two thrusting heads 18*a*, 18*b* push the lateral areas 2*a*, 2*b* downwards with respect to the upper side of the plates 6*a*, 6*b*, and introduce the areas 2*a*, 2*b* in the openings 8*a*, 8*b* of the same plates 6*a*, 6*b*.

While the lateral areas 2*a* and 2*b* are pushed downwards, the main part 3 of the blank 1 and the central area 2*c* of the portion 2 rest on the plates 6*a*, 6*b* and on the conveyor 4, and consequently only the areas 2*a* and 2*b* can lower causing detachment of the portion 2 from the main part 3 along the breaking lines defined by sections A–B, E–F.

During the detachment step, the element 20 and the related suction cups 21 are free to oscillate with a counter-clockwise rotation about the pin 19, thus allowing relative movement of the assembly 20–21 with respect to the thrusting head 18*a*, 18*b* so that further lowering of the thrusting head with respect to the above mentioned assembly 20–21 is not hindered.

Still in same detachment step, the suction cups 21 keep the portion 2 gripped, so that possible movements of the portion 2 with respect to the gripping and pushing means 12, also occurring after the portion has been fully detached, are prevented.

In the meantime, the elastic means 10*a*, 10*b* oppose the downward movement of the thrusting heads 18*a*, 18*b*, thus preventing the system from vibrations by damping the detachment.

While the gripping-pushing means 12 are lowering towards the portion 2 of the blank, and/or while they are further going down to detach the portion 2, and anyway before the said portion 2 is shifted, the gluing means 32*a*, 32*b* spray the glue upwards through the openings 8*a*, 8*b* thus applying a layer of glue on the surface of the portion 2 turned downward and delimited by the openings 8*a*, 8*b*.

Figure 5:
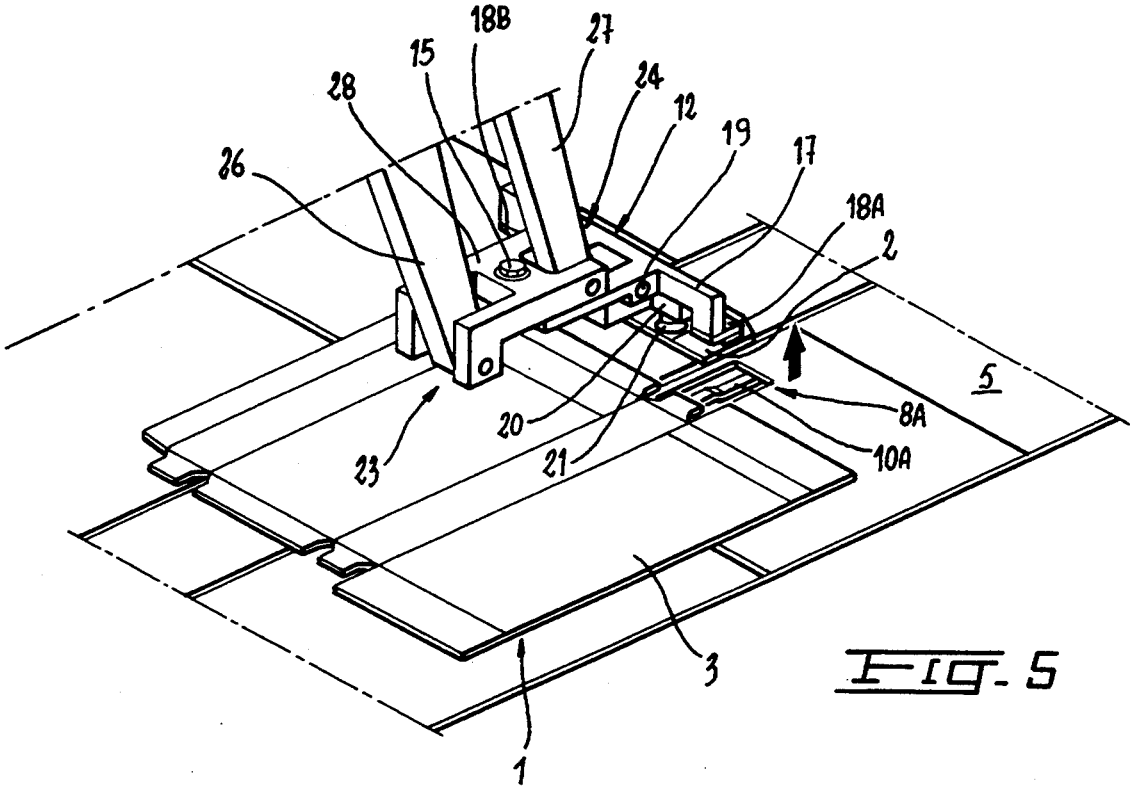
FIG. 5 is a perspective view of a part of a device during the translation of the detached portion of the blank.

Upon completition of the portion detachment (see FIG. 5), the clockwise rotation of the shaft 30 makes the gripping-pushing means 12 raise, so that thrusting heads 18*a*, 18*b* leave the openings 8*a*, 8*b* and the portion 2, held by the suction cups 21, is raised over the sliding surface.

Then, due to the clockwise rotation of the shaft 31, the linked parallelogram oscillates downstream with respect to the conveying line, and the gripping-pushing means 12 are shifted forward with respect to the main part 3 of the blank 1 that is dwelling.

Figure 6:
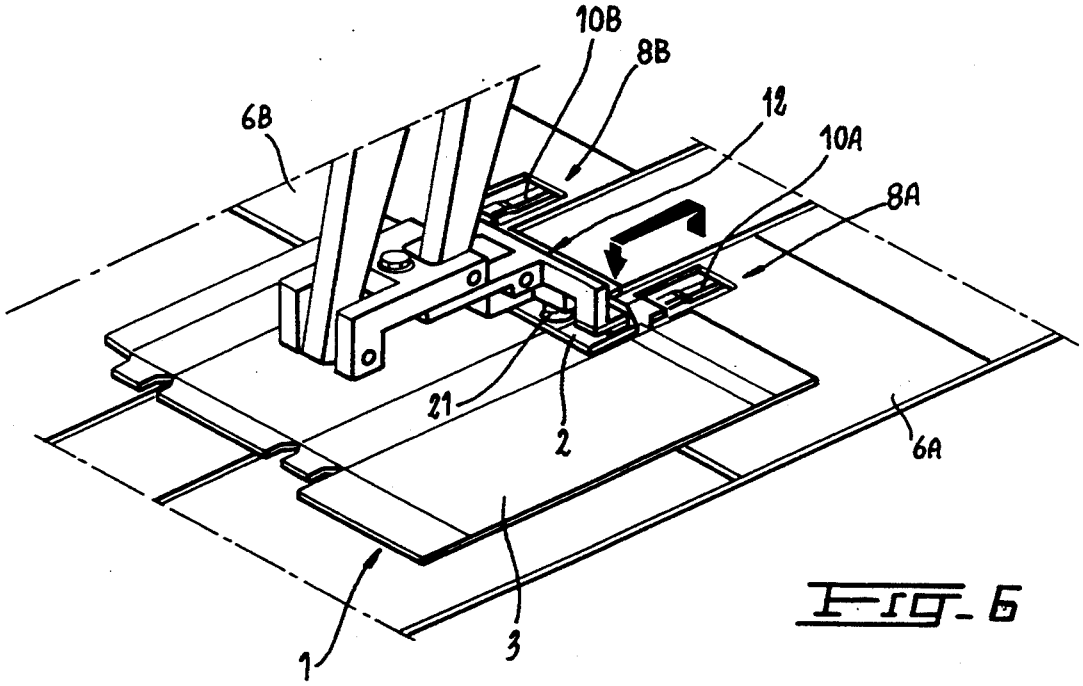
FIG. 6 is a perspective view of a subject device during reattachment of the detached portion of the blank.

When the linked parallelogram reaches its extreme downstream point, (see FIG. 6), the arm 27, it is lowered again by the counter-clockwise rotation of the shaft 30, and the portion 2, with spots of glue on its lower surface, is put down on top of the main part 3, thus obtaining the configuration shown in FIG. 7.

Once this step is completed, the suction cups 21 are deactivated, the arm 27 is raised, and the gripping-pushing means 12, due to the counter-clockwise rotation of the shaft 31, oscillate so as to return to the extreme upstream point. In the meanwhile, the conveyor 4, by a subsequent step, moves away the blank 1 from the said station S1 and brings therein the next blank to be processed.

At this point, the processing cycle is again at the initial step and a new blank can be processed.

If the size of the blanks is changed and the device must be adapted accordingly, the changeover operation is quick and easy to be carried out.

In particular, it is enough to change, by unscrewing the screw 15, the gripping-pushing means 12 and the supporting plates 6*a*, 6*b*, i.e. the so called "size changeover" parts, which are supplied directly by the producer according to different blank sizes that are planned to be used.

The glue spraying means 32*a*, 32*b* can be adjusted with respect to the new plates 6*a*, 6*b* by simple rotation of the adjustment handwheels 33*a*, 33*b*.

It is understood that what above has been described as a mere, not limitative example, therefore all possible constructive variants are protected by the present technical solution, as described above and claimed in the following.

What is claimed is:

1. In an operative station of a case erecting line, in which a case blank including a main part and a detachable portion is made to dwell to detach said portion from said main part and to reattach said portion to another zone of said main part, a device for detaching said portion from said main part, shifting said portion with respect to said main part and reattaching said portion to said main part, said device including:

gripping-pushing means designed to grip, detach and move said portion of said blank;

supporting means aimed at supporting said main part of the blank, allowing free downwards movement for said portion;

operating means having the task of driving said gripping-pushing means; and gluing means provided for applying glue to a surface of said portion to be attached to said main part of said blank.

2. Device according to claim 1, wherein said gripping-pushing means include:

a carrier member fastened removably to said operating means;

a transversal bar supported by said carrier member and featuring thrusting heads turned downwards; an element bound to said carrier member and equipped with a plurality of suction cups turned downwards.

3. Device according to claim 2, wherein said element is pivoted to said carrier member so that said element can oscillate vertically with respect to said pushing element.

4. Device according to claim 1, wherein said supporting means include a couple of removable plates featuring openings made therein to allow free downward movement for said portion.

5. Device according to claim 4, wherein elastic means are situated at bottom of said openings and aimed at opposing downwards thrust of said gripping-pushing means.

6. Device according to claim 1, wherein said operating means comprise a linked parallelogram including:

a first arm having one end keyed onto a shaft driven to oscillate rotatably;

a second arm having one end hinged to an element driven to swing vertically;

a connecting yoke hinged to free ends of said first and second arms and carrying said gripping-pushing means.

7. Device according to claim 1, wherein said gluing means are situated below the supporting means and apply glue to a lower surface of said portion of said blank through openings made in said supporting means.

8. Device according to claim 7, wherein the position of said gluing means is adjustable with respect to said openings.

* * * * *